US005957585A

United States Patent [19]

Dabrowski

[11] Patent Number: 5,957,585

[45] Date of Patent: Sep. 28, 1999

[54] GUTTER TROLLEY WITH BAG

[75] Inventor: Jerzy Y. Dabrowski, 1650 St. Bernard Street, Gloucester, Ontario, Canada, K1T 3P7

[73] Assignee: Jerzy Y. Dabrowski, Gloucester, Canada

[21] Appl. No.: 09/092,946

[22] Filed: Jun. 8, 1998

[51] Int. Cl.[6] ..... B65D 33/02; B65D 33/14

[52] U.S. Cl. ..... 383/12; D34/5; 211/162; 248/99; 248/318; 383/22; 383/33

[58] Field of Search ..... 383/12, 22, 33, 383/34; 248/318, 99, 98, 129; 211/162; D34/5

[56] References Cited

U.S. PATENT DOCUMENTS

| | | | |
|---|---|---|---|
| 834,726 | 10/1906 | Henry | 383/12 |
| 929,430 | 7/1909 | Hill | 383/12 |
| 2,318,735 | 5/1943 | Bickford | 383/12 |
| 2,647,550 | 8/1953 | Cannon | 383/12 |
| 2,917,260 | 12/1959 | Barber et al. | 383/12 |
| 4,202,521 | 5/1980 | Harding | 248/98 |
| 4,917,393 | 4/1990 | Rogers | 248/99 |
| 5,268,969 | 12/1993 | Duran, Jr. . | |
| 5,697,508 | 12/1997 | Rifkin et al. . | |

*Primary Examiner*—Stephen P. Garbe
*Attorney, Agent, or Firm*—Marks & Clerk

[57] ABSTRACT

A combination trolley and bag to receive and hold leaves and debris cleaned from a rain gutter (eavestrough). The trolley includes a pair of rolling sheaves that ride on the outside edge of the gutter to transport leaves and debris from the initial point to the next section to be cleaned or until the bag is full. Safety flaps attached to the same shaft as sheaves work as a stopper to keep the device in place in case the sheaves slide off the gutter edge. The safety flaps spin freely to by pass any obstacle in the gutter such as brackets, holding nails, or fastening devices which secure the gutter to the roof. Two support arms, which hold and secure the bag, hinge to an up position for flat and easy storage. When lifting one of the support arms and holding handle at the bottom of the bag, emptying becomes easy. Bag size is determinate by weight of leaves and debris, so when full, can be easily lifted off the gutter edge, brought down and emptied.

7 Claims, 3 Drawing Sheets

GUTTER TROLLEY WITH BAG

FIELD OF THE INVENTION

This invention relates to a device for use when cleaning debris from a rain gutter (eavestrough) and more particularly to a hanging trolley with an attached bag for receiving and holding the debris removed from the gutter.

Background

Rain gutters require frequent cleaning in order to remove leaves and other debris which collect in them during the year. The normal procedure for removing such debris is for a person to either go onto the roof or stand on a ladder and manually remove the leaves and throw them down onto the ground. After the gutter had been completely cleaned, the person then has to rake the leaves into a pile and put them into a bag or other receptacle. This method of cleaning the rain gutter is both laborious and time consuming. Other disadvantages of this method of cleaning is that the gutter debris will sometimes fall into beds of flowers or onto other objects such as shrubs, patio furniture, etc. Throwing debris from the rain gutter also poses a risk of injury to other people in the area, especially children.

Prior Art

A search of the prior art has located one patent related to the subject matter of the present invention. This is U.S. Pat. No. 5,268,969 which issued Dec. 7, 1993 to Robert Duran, Jr. This patent, entitled "Gutter Bag" describes a hang bag for suspension from a rain gutter and which may be lifted and moved or slid along the gutter during a cleaning operation. The hang bag of this patent has a pair of hooks to engage the outer edge of the gutter. The hooks are located along one side of the frame which supports the bag and a pad or stand-off is attached to the frame to rest against the side of the gutter so as to keep the bag in a generally vertical orientation. The weight of the debris, especially wet leaves, coupled with the drag introduced by the pad makes it difficult to slide the hang bag along the gutter. Additionally, the nails or other fasteners used to hold the gutter to the eaves prevents continuous sliding of the hang bag along the gutter. To lift the bag and place it in another location on the gutter while the user is standing on the roof or on a ladder places the user in considerable danger. The gutter bag of the prior patent has a handle on each end of the bow shaped frame. Thus, when the bag is full a user must use both hands to carry the unit in order to avoid spilling the contents. This presents a dangerous situation when the user has to climb down a ladder to empty the bag.

The hanging trolley of the present invention distinguishes over the above patent and other prior art known by the inventor by having sheaves that roll on the edge of the gutter to transport the bag, for receiving leaves and debris, from one point to another. When the load in the bag increases, it is still easy to push and roll the trolley along the gutter instead of lifting a container every time the next section is to be cleaned.

The present invention represents a solution which is simple, inexpensive and more functional than the known arrangements.

SUMMARY OF THE INVENTION

The present invention seeks to eliminate the risk of injury arising when a person cleans the gutters while standing on a ladder holding a bag or basket in one hand and clears the debris from the gutter with their other hand. The hanging trolley of the present invention provides a convenient way of supporting a bag for holding the debris thereby leaving one of the user's hands free to hold on to the ladder or other supports. Further, the free rolling trolley permits the user to easily move the bag along the gutter until a section has been cleaned or until the bag is full.

One object of the present invention is to improve and make safer the cleaning of leaves and debris from a rain gutter. The hanging trolley according to the present invention is generally designed for homeowners but even general contractors might find this device very handy.

Therefore, in accordance with a broad aspect of the present invention there is provided a trolley with a bag for receiving and holding leaves and debris during cleaning of a rain gutter (eavestrough).

In accordance with a more specific aspect of the present invention there is provided a hanging trolley for use when cleaning debris from a rain gutter the trolley having a first generally rectangular frame for supporting a bag into which the debris is placed, a second U-shaped frame attached perpendicularly to the first frame and having a pair of sheaves rotateably attached thereto, the sheaves configured to roll on the outer longitudinal edge of a rain gutter.

BRIEF DESCRIPTION OF THE DRAWINGS

The invention will now be described in greater detail with reference to the attached drawings wherein.

DETAILED DESCRIPTION OF THE INVENTION

Figure 1:
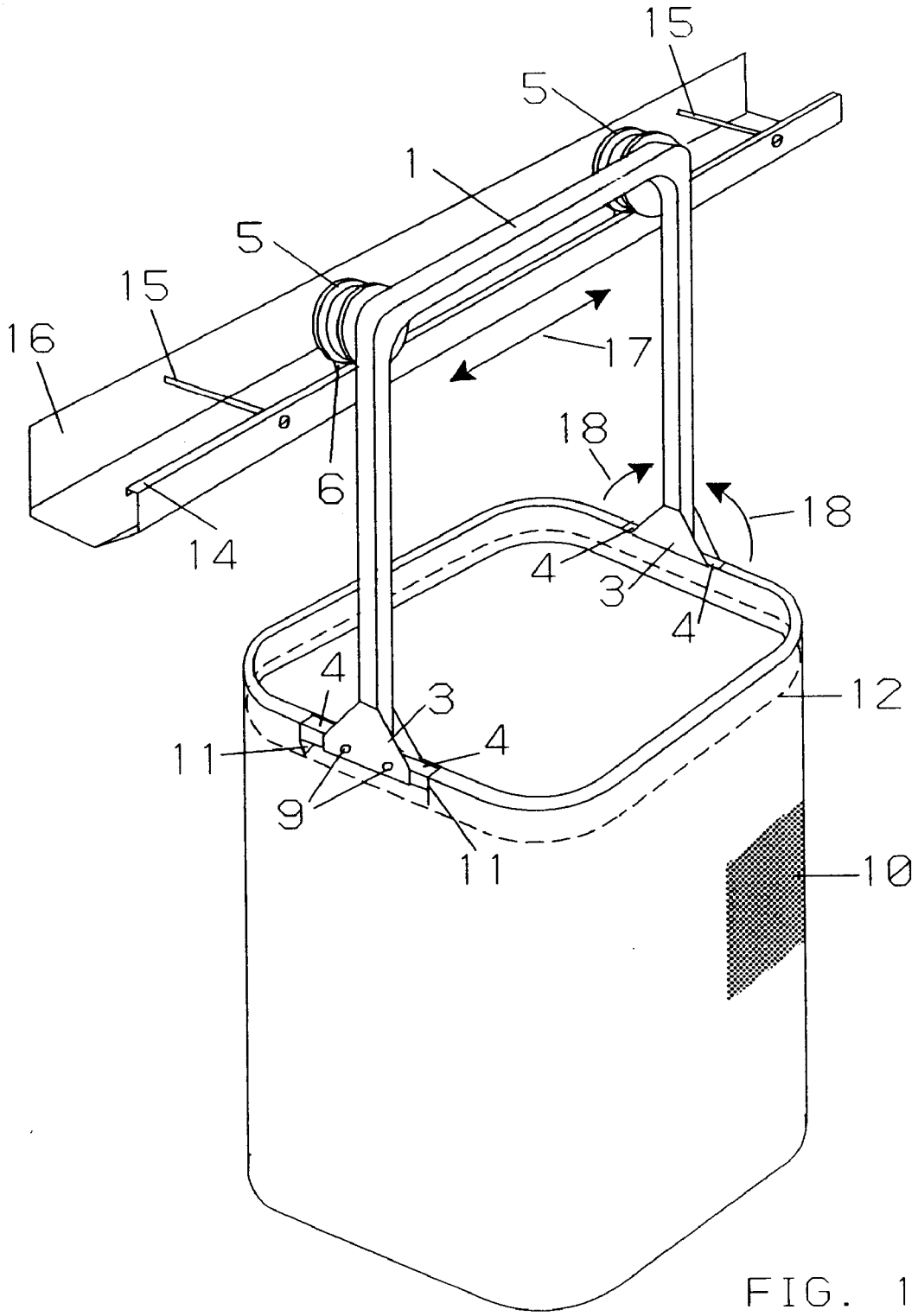
FIG. 1 is a perspective view of the hanging trolley in a working position on a gutter.

With reference to FIG. 1 the trolley with attached debris bag is shown in a working position on the edge 14 of a gutter 16. The gutter 16 may be secured to the roof by different, fastening apparatus as is well known. In FIG. 1 the gutter is attached to the eave with nails 15.

Figure 4:
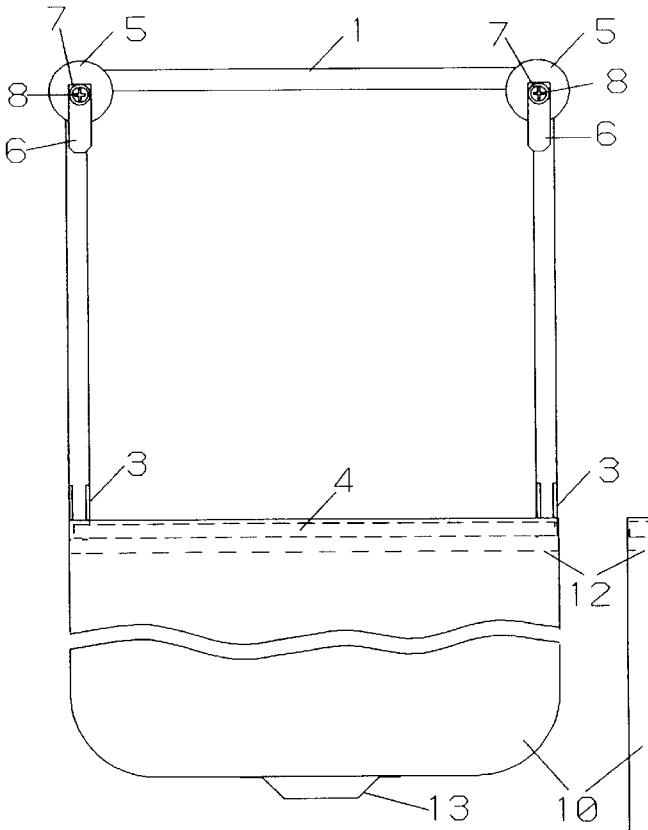
FIG. 4 is a front view thereof.
Figure 5:
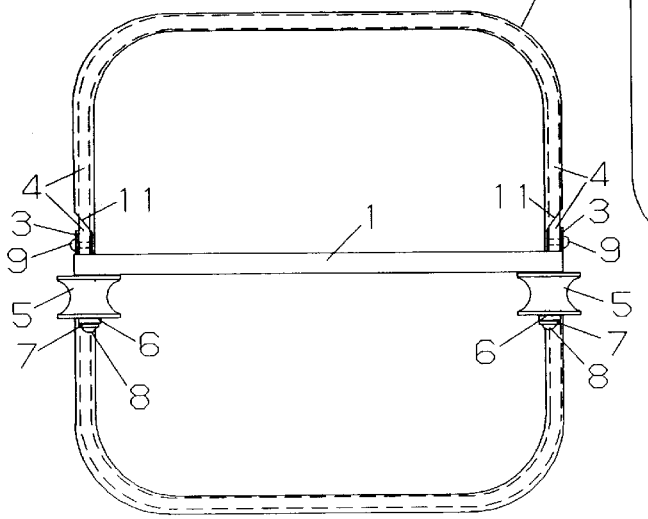
FIG. 5 is a top plan view thereof.
Figure 6:
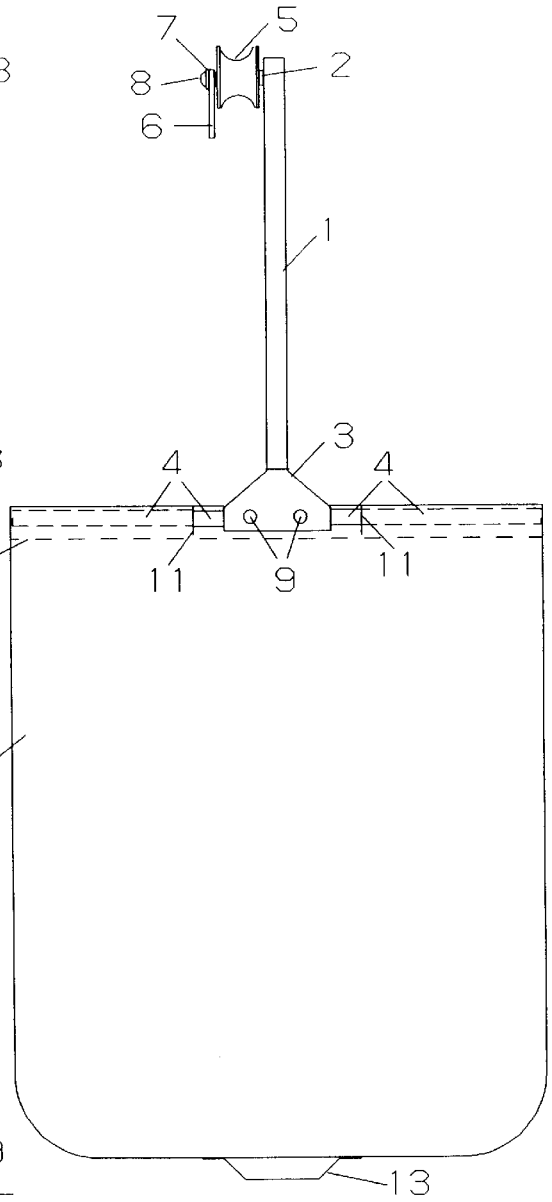
FIG. 6 is a side view thereof.

The hang trolley according to the invention comprises a Ushaped main frame 1 with a pair of rolling sheaves 5. The sheaves are free to roll in both directions (left or right) as indicated by arrow 17. Main frame 1 is attached to support arms 4, arms 4 serving to carry bag 10. As shown in FIG. 1 support arms 4 are connected to frame 1 by hinges 3 such that arms 4 can swing in the direction of arrows 18. This permits the arms 4 to fold to a position adjacent frame 1 when the trolley is not in use for easy storage. Further, one of the arms can be lifted to a position along frame 1 to allow for easy emptying of bag 10. Thus, emptying becomes easy when one support arm is lifted to an up position and held with the main frame 1 with one hand, while the user's other hand holds the bottom of the bag, which may optionally have a handle 13 as shown in FIGS. 4 and 6. By pivoting open the bag towards the ground, debris readily exits the bag.

Figure 2:
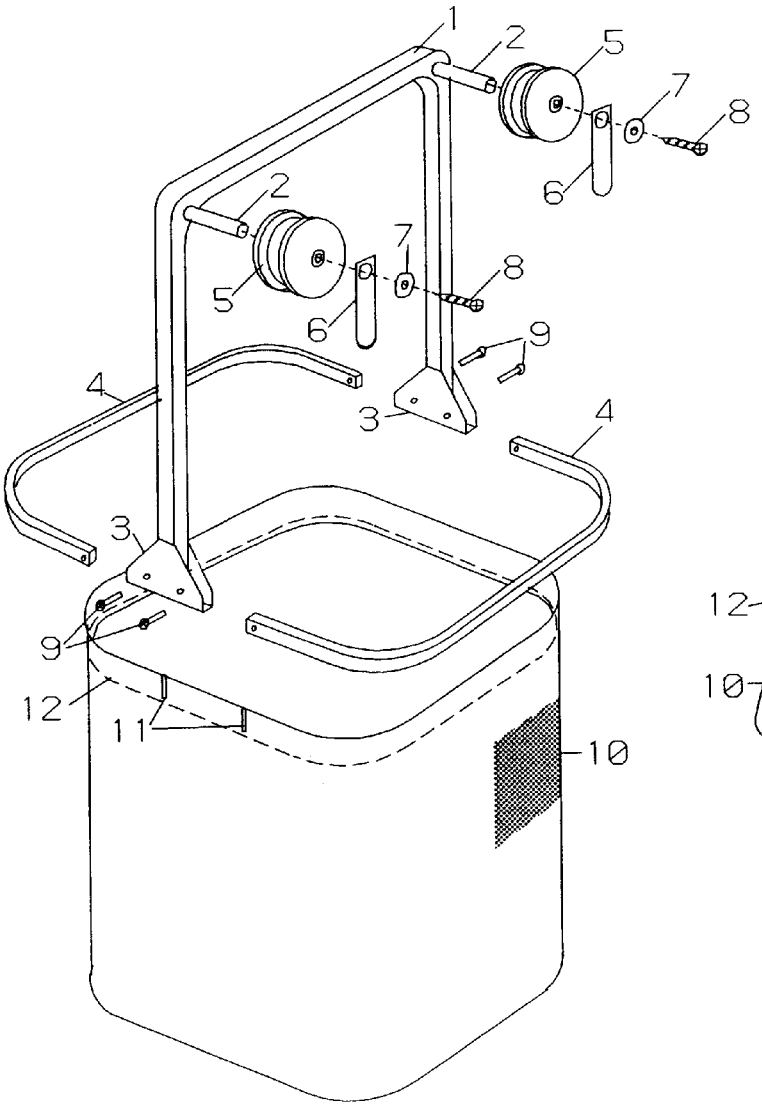
FIG. 2 is a perspective parts/assembly view of the trolley of FIG. 1.
Figure 3:
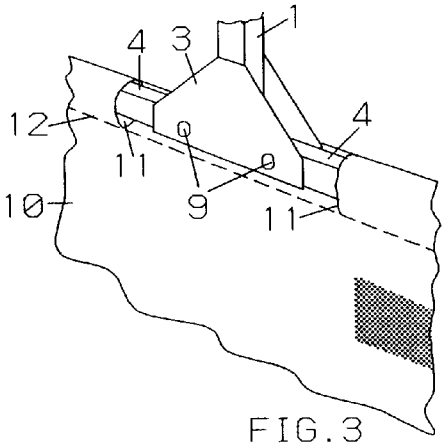
FIG. 3 is a partial perspective view of a portion of the main frame hinge and bag support arms.

A preferred embodiment of the trolley with bag is best shown in FIG. 2. Main frame 1 of the trolley contains two shafts 2 and two hinge members 3. Main frame 1, shafts 2 and hinge members 3 can be made of a plastic material and conveniently formed as one plastic mould. Of course, the frames and other components can be made from other materials such as aluminum, wood, etc. Sheaves 5 are held on shafts 2 and free to rotate thereabout. Safety hooks or flaps 6 and braking washers 7 are secured to the shafts 2 with screws 8. Washer 7 applies pressure to the sheaves so as not to spin too freely. Safety hooks or flaps 6 serve to hold the trolley on the gutter in case sheaves 5 slide off the gutter edge 14. The safety hooks 6 spin freely upwards in order to pass over any fastening devices such as nails 15 that secure the gutters to the roof.

Bag 10 in a preferred embodiment is made from woven polypropylene material that allows water to seep through when filled with wet leaves and debris. Of course, a smaller, nonporous plastic bag or the like can be used inside the woven bag if it is preferable to avoid leakage of liquid from the container. The top edge of the bag 10 is folded and stitched 12 in a 'pocket' manner to accommodate support arms 4 through slots 11. After securing the arms inside the pocket the support arms 4 are placed inside hinge members 3 and secured with rivets 9. It will be apparent to one skilled in the art that alternate methods of attaching the bag to the support arms and the support arms to the frame can be devised. As previously discussed the two supporting arms 4 fold to an up position for easy storage. By lifting one supporting arm 4 to an up position and holding with one hand toward main frame 1 while a second hand holds the handle 13 (FIGS. 4 & 6) at the bottom of the bag 10, emptying becomes easy.

As shown in FIG. 1 the main frame 1 is joined substantially centrally to the support arms 4. Thus, the bag 10 hangs generally vertically when the sheaves 5 are positioned on the gutter edge 14. No stand-off or pad, as used in the prior art device, is required and hence the trolley is easy to roll along the gutter even when filled with debris. Additionally the centrally located frame 1 means that a user can hold the hang trolley between sheaves 5 in one hand while climbing down a ladder and the bag will remain in an upright position.

It will also be apparent that a user can make use of a scoop or other cleaning device for removing the debris from the gutter and placing it in the bag 10. By using a scoop, etc. with an extended handle the trolley can easily be pushed along the gutter to a location some distance from the ladder and still be conveniently located for receiving debris. When a section of the gutter has been cleaned but the bag is not full the user can leave the trolley on the gutter, climb down and move the ladder to the next section to be cleaned which will be evident by the location of the trolley.

While a particular embodiment of the invention has been described and illustrated it will be apparent that numerous changes can be made to the basic concept. It is to be understood that such changes will fall within the scope of the invention as defined by the appended claims.

I claim:

1. A hanging trolley for use when cleaning debris from a rain gutter having an open top and inner and outer longitudinal edges, the trolley having a first generally rectangular frame for supporting a bag into which the debris may be placed, and a second U-shaped frame attached perpendicularly to said first frame and having a pair of sheaves rotateably attached thereto for rolling engagement with said outer longitudinal edge of said rain gutter.

2. A hanging trolley as defined in claim 1 wherein said second frame is attached substantially centrally on said first frame.

3. A hanging trolley as defined in claim 2 wherein said first frame comprises a pair of U-shaped members pivotally attached to said second frame whereby at least one of said U-shaped members may be pivoted to lie adjacent said second U-shaped frame member.

4. A hanging trolley as defined in claim 1 wherein each of said pair of sheaves is rotateably positioned on shaft members longitudinally spaced on said U-shaped frame.

5. A hanging trolley as defined in claim 4 wherein each of said shaft members has a rotateable safety flap member for retaining said sheaves on said longitudinal edge of said gutter.

6. A hanging trolley as defined in claim 1 having a bag supported by said first frame wherein said bag is formed of a liquid pervious material.

7. A hanging trolley as defined in claim 6 where said bag is provided with a handle on an end opposite said supporting frame.

* * * * *